United States Patent [19]

Lemelson

[11] 3,947,992

[45] Apr. 6, 1976

[54] MOLDING TOY

[76] Inventor: Jerome H. Lemelson, 85 Rector St., Metuchen, N.J. 08840

[22] Filed: Mar. 10, 1975

[21] Appl. No.: 556,978

Related U.S. Application Data

[63] Continuation-in-part of Ser. No. 395,410, Sept. 10, 1973, Pat. No. 3,869,824, and a continuation-in-part of Ser. No. 223,148, Feb. 3, 1972, abandoned.

[52] U.S. Cl. ..... 46/17

[51] Int. Cl.[2] ..... A63H 33/06

[58] Field of Search..... 46/1 R, 16 R, 17, 30, 37

[56] References Cited

UNITED STATES PATENTS

| | | | |
|---|---|---|---|
| 3,137,967 | 6/1964 | Flieth | 46/30 |
| 3,243,895 | 4/1966 | Girard | 46/17 |
| 3,594,940 | 7/1971 | Yonezawa | 46/16 |

*Primary Examiner*—Louis G. Mancene
*Assistant Examiner*—Robert F. Cutting

[57] ABSTRACT

A molding toy and craft is provided employing different colored liquid or molten casting materials and an open mold having compartments for receiving and retaining quantities of the different colored casting materials to form a composite article of the mold and casting materials. The mold wall is formed with partitions between the compartments which are so colored or decorated to represent metal of the type employed in fabricating jewelry and stained glass articles.

4 Claims, 22 Drawing Figures

MOLDING TOY

RELATED APPLICATIONS

This is a continuation-in-part of Ser. No. 395,410 filed Sept. 10, 1973 now U.S. Pat. No. 3,869,824 issued Mar. 4, 1975 for Assembly Toy & Craft as a continuation-in-part of Ser. No. 223,148 filed Feb. 3, 1972 now abandoned.

SUMMARY OF THE INVENTION

This invention relates to improvements in molding toys and crafts and articles produced therefrom.

A variety of crafts have been developed and utilized to produce articles of jewelry and artifacts which are made of different colored components such as plastic or glass chips. These articles require the matching of the colored components with cavities formed in the base on which they are applied, the special alignment of the components in the cavities and the bonding or otherwise retainment of the components against the base. Such procedures are tedius and frequently result in assemblies which may easily come apart. The instant invention comprises a structure in a mold which forms part of a finished article and which is so colored or decorated as to provide at least portions thereof representing metallic portions of the finished article.

Accordingly, it is a primary object of this invention to provide new and improved molding toys and crafts which may be utilized to produce a variety of different brightly colored articles.

Another object is to provide an improved structure in a casting mold for a molding toy which is simple and inexpensive to produce.

Another object is to provide a craft employing a plastic mold which becomes part of the finished article and contains portions thereof which are shaped and decorated to represent metallic portions of the finished article.

Another object is to provide a craft employing a mold having the general configuration of a piece of jewelry and containing compartments in which liquid molding material may be disposed and cast to shape to represent jewels or brightly colored portions of the finished article.

Another object is to provide a mold for use in a craft and toy which is in the configuration of a finger ring or bracelet.

With the above and other such objects in view as may hereafter more fully appear, the invention consists of the novel constructions and combinations of parts set forth in the following specification and accompanying drawings but it is to be understood that changes and modifications may be resorted to which come within the purview of the invention as claimed without departing from the spirit and nature of the invention.

Figure 1:
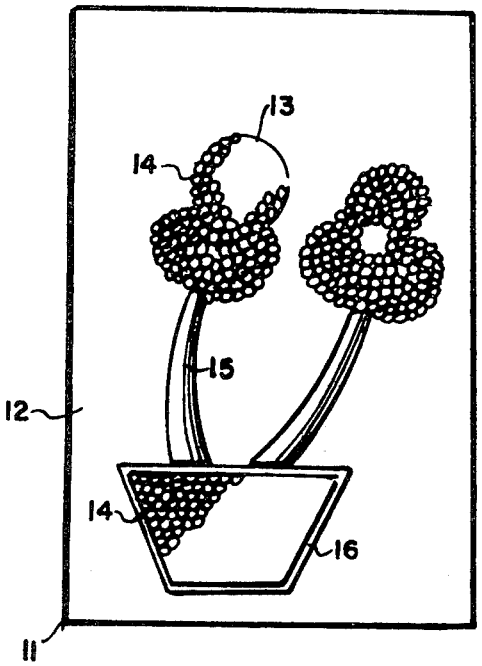
FIG. 1 is a plan view of an assembly toy or craft which is partially completed and shows various features of the instant invention including a substrate in the form of a plaque containing decorative elements secured thereto.

In FIG. 1 is shown an art assembly toy 10 composed of a base sheet 11 made of paper, paperboard, plastic or metal or a laminate of such materials. The base sheet 11 may also contain flocking on its outer surface 12 against which outer surface a plurality of art components may be secured to form pictures, collages or the like.

Shown printed on the outer surface 12 of sheet 11 are a plurality of outlines 13 defining borders within which certain of the picture making components may be secured in accordance with indicia 13' provided within each border such as a color dot, number or other visual indicator of the component or components to be provided within the border. In other words, the lines 13 may be formed as a plurality of totally enclosed printed configurations within the borders of each of which specific materials are to be assembled or cemented to form composite pictures and constructions.

The components to be assembled within the confines of the printed areas 13A defined by lines 13 printed on the surface 12 of the sheet 11, preferably include symmetrical plastic shapes such as small circular buttons 14 which may be provided as single buttons or beads or symmetrical arrays of same. The configurations also may comprise small, separate, short cylindrical formations or arrays of such formations as illustrated in FIGS. 5–7 and 9 of the drawings.

In FIG. 1, the small buttons 14 are cemented to the surface 12 with a suitable adhesive in closely spaced relationship, preferably such that the abut each other to totally fill the areas 13A in the color arrays indicated to form, for example, the petals and leaves of flowers or other configurations such as animals, fishes, figures, landscape representations and the like. When totally filling the areas indicated on the surface 12 by the indicia 13 in accordance with the requisite colors, the effect is such as to generate colorful pictures with the plastic members 14.

A second assembly technique is also illustrated in FIG. 1 which involves providing one or more fence-like plastic formations 16 either as separate molded frames to be properly bonded to the surface 12 by the person assembling the picture or as formations which are integrally molded with the base sheet 11 by vacuum forming a sheet of plastic or injection molding same. The frame 16 of FIG. 1 is shaped to represent a flower pot and it is noted that the same frame, other frame units or formations of sheet 11 may also extend to represent the borders of the illustrated flower stems and flower petals.

Once the frame or frames 16 have been properly adhesively bonded or otherwise secured to the base sheet 11, the plastic buttons or tubes 14 may be either frictionally assembled within the areas 16' defined by the frames 16 or cemented therein. As part of the artwork the frames 16 may be retained on the base sheet or removed thereafter leaving only the formations 14 in place.

Figure 2:
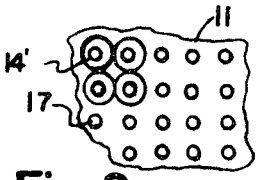
FIG. 2 is a plan view of a fragment of a modified form of the plaque of FIG. 1 showing certain surface decorating elements secured thereto.

FIG. 2 shows a first assembly technique for short single tubular formations 14'. The base sheet 11 is shown provided with a multitude of closely spaced, substantially cylindrical pin-like proturbances 17 formed in its upper surface which retain the cylindrical formations 14' closely adjacent and preferably in contact with each other as illustrated. In a particular construction, the formations 17 may be so spaced and the dimensions of the sort cylindrical formations 17 such that when said formations are pushed over adjacent proturbances 17, they will frictionally engage the surface of adjacent formations 17 in such a manner assto frictionally hold each other in place. In another construction, the proturbances 17 may be slightly tapered outwardly and dimensioned such that at least part of their outer surfaces will frictionally engage the inside surfaces of the cylindrical formations 14' frictionally holding them in place after they are pushed thereon by the craftsman.

Figure 3:
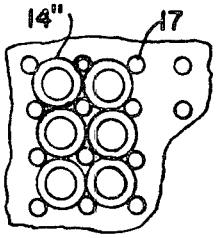
FIG. 3 is a plan view of a fragment of the plaque of FIG. 2 showing other types of surface decorating elements secured thereto.

FIG. 3 a plurality of cylindrical formations 14'' are shown each frictionally secured between surfaces of four of the pinlike proturbances 17 and may each also be shaped to engage the surfaces of adjacent cylindrical formations to frictionally retain same in place.

Figure 4:
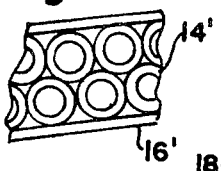
FIG. 4 is a plan view of a fragment of a plurality of surface decorating elements and a frame retaining same in edgewise abutment as applicable to the plaque of FIG. 1.

In FIG. 4, short cylindrical formations 14' are shown packed between the walls 16w of a frame 16 similar to frame 16 of FIG. 1. They may thus be frictionally retained in place if suitably disposed as illustrated. The formations 14' may be made of a suitable deflectable plastic as may be the walls **16*w* of the frame 16** to enhance the frictional retention of all components together.

Figure 5:
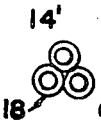
FIG. 5 is a plan view of a cluster of three surface decorating elements formed together and applicable as a surface decorating element for a constructional plaque of the type shown in FIG. 1.

In FIG. 5, a unitary molding 18 is shown composed of three closely spaced, short tubular formations 14' of the type illustrated in FIG. 1. A plurality of assemblies 18 may be utilized and has one of the components of the assembly toy of FIG. 1 to reduce the amount of time and effort needed to completely in the areas defined by indicia 13 or frame 16.

Figure 6:
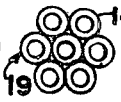
FIG. 6 is a plan view of another form of decorating element comprising a cluster of seven rings formed into an integral molding and applicable to the decorating plaque craft of FIG. 1.

In FIG. 6, seven formations 14 are integrally molded together in an assembly 19 which will nest with other assemblies to fill in total areas as desired.

Figure 7:
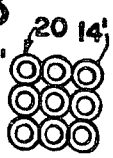
FIG. 7 is a plan view of another form of decorating element comprising a cluster of nine rings formed together of a single molding and applicable to the plaque craft structure of FIG. 1.

In FIG. 7, nine tubular formations 14 are integrally molded as a unit assembly 20 of substantially rectangular shape and may be utilized in the assembly of art work of the type shown in FIG. 1.

Figure 8:
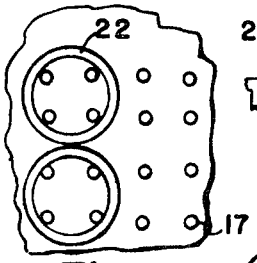
FIG. 8 is a plan view of a fragment of the board of FIGS. 2 and 3 showing modified form of surface decorating element frictionally assembled therewith.

In FIG. 8, a circular array of tubular formations 14' is provided as a unitary molding 21 which may be utilized as a components or components of the art toy of FIG. 1 and may abut similar formations adjacent thereto as well as being filled with a circular array of tubular components 14 similar to those provided in the array 21 but perhaps of a different color.

Figure 9:
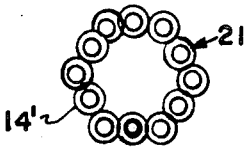
FIG. 9 is a plan view of a circular array of ring-shaped decorations which are integrally molded in a ring-shaped cluster and applicable to the plaque craft of FIG. 1.

In FIG. 9, a plurality of thin walled cylindrical picture components 22 are each shown assembled around four of the proturbances 17 of the sheet similar to that shown in FIG. 2 and, in addition to possibly frictionally engaging the proturbances 17, they may also be configured to externally frictionally engage each other to frictionally retain the components in place on the base sheet 11.

Figure 10:
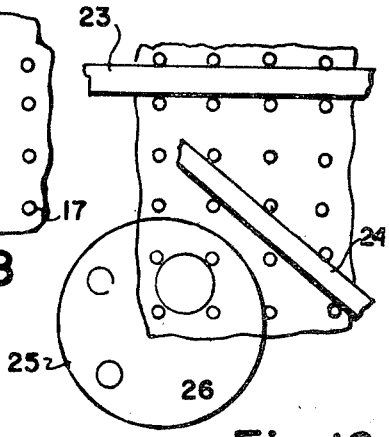
FIG. 10 is a plan view of a fragment of a board of the type shown in FIG. 2, showing various elements frictionally assembled thereto.

In FIG. 10, several picture components are illustrated including first strips 23 of extruded or molded plastic which are shown frictionally engaged between two rows of protruding pinlike formations 17 formed in the base sheet 11, which rows are two of a pluraltiy of such rows extending across the base sheet. Also shown in FIG. 10 is a second strip formation 24 of plastic, metal or wood which extends diagonally between protruding pinlike formations as illustrated and is preferably frictionally retained against the base sheet 11.

Figure 11:
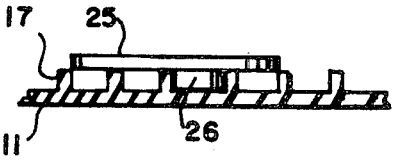
FIG. 11 is an edge view in cross section of a board of the type shown in FIG. 10 showing one of the surface decorating elements frictionally secured thereto.

A further component 25 which is preferably an injection molding containing one or more cylindrical formations 26 protruding from its undersurface, is secured to the base sheet 11 by positioning and pushing the component to dispose the formations or formations 26 between four of the protruding pin-like formations 17 on the sheet. While formation 26 is shown as a solid projection it may also comprise a hollow cylindrical projection, the interior surface of which is pushed over one protruding, pin-like formation 17 of the base sheet. FIG. 11 is a side view showing the protrusion 26 from component 25 nested between adjacent pin-line formations 17 of the base sheet 11.

Figure 12:
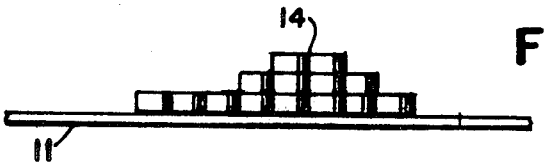
FIG. 12 is an end view of the board of FIG. 1 showing surface decorating elements in stacked assembly thereon.

In FIG. 12, a plurality of small cylindrical formations 14 or arrays thereof as illustrated in FIGS. 5–8, are shown cemented or othewise secured to a base sheet 11 as described, not only in a single layer but in a plurality of layers extending one above the other. These layers may be so disposed as to provide three dimensional effects on the upper surface 12 of sheet 11.

It is also noted that components such as 25 of FIG. 11, which may comprise parts of art work forming a total picture or configuration on the outer surface of the base sheet, may also be externally decorated by cementing components of the types provided in FIGS. 5–9 thereto or by frictionally assembling such components on pin-like formations molded in the outer surface of the component 25. Also the strips 23 and 24 of FIG. 10 may comprise hollow rectangular or cylindrical tubing or bendable wires, flexible plastic rod or tubing or the like which may be bent into any desired configuration along the surface of the base sheet.

Figure 13:
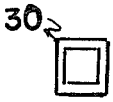
FIG. 13 is a plan view of a modified form of surface decorating element in the form of a hollow rectangle.

FIG. 13 shows a rectangular hollow configuration 30 which may be utilized per se or in arrays thereof forming unitary moldings to be assembled to the base sheet as described either by adhesive bonding, frictional retention against suitable proturbances formed in the surface of the base sheet or by pin means extending through the triangular configuration.

Figure 14:
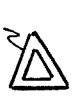
FIG. 14 is a plan view of a modified form of surface decorating element in the shape of a hollow triangle.

FIG. 14 shows a triangular art unit 31 replacing the cylindrical units hereinbefore described which may be utilized per se or in clusters forming unitary moldings which units or clusters may be bonded or frictionally retained against the art base sheet.

Figure 15:
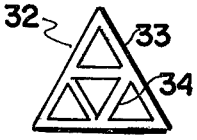
FIG. 15 is a plan view of a modified form of surface decorating element in the form of a plurality of integrally moled hollow triangles.

FIG. 15 shows a modified form of triangular decorative component 32 having three brace or filler strips 34 extending between adjacent walls 33 of the component.

Figure 16:
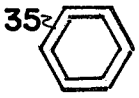
FIG. 16 is a plan view of a modified form of surface decorating element in the shape of a hollow hexagonal shaped element.

FIG. 16 shows a six-sided art configuration 35 which may also be utilized per se or in unitary molded clusters as described to form art configurations by adhesively bonding or frictionally retaining same in assembly with a base sheet as described.

Figure 17:
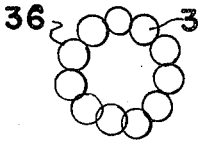
FIG. 17 is a plan view of a cluster of spherical or short cylindrical elements applicable for forming surface decorations of the type showin in FIG. 1.

FIG. 17 shows another decorative configuration or component 36 in the shape of a cluster of small sphere-like formations 37 which are molded together as a single unit and nest in peripheral surface abutment with similarly shaped units to fill a decorative area as described.

Figure 18:
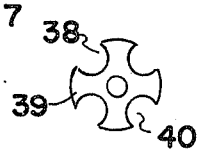
FIG. 18 is a plan view of yet another form of surface decorating element which is designed to edgewise nest with similar elements to decorate a surface therewith.

In FIG. 18 is shown another form of decorative component 38 having four dovetailed portions 39 with indentations 40 between each two of such portions into which the dovetailed portions of other similar components may be made to nest to decorate a selected area of the surface of an art board or figure as described herein.

Figure 19:
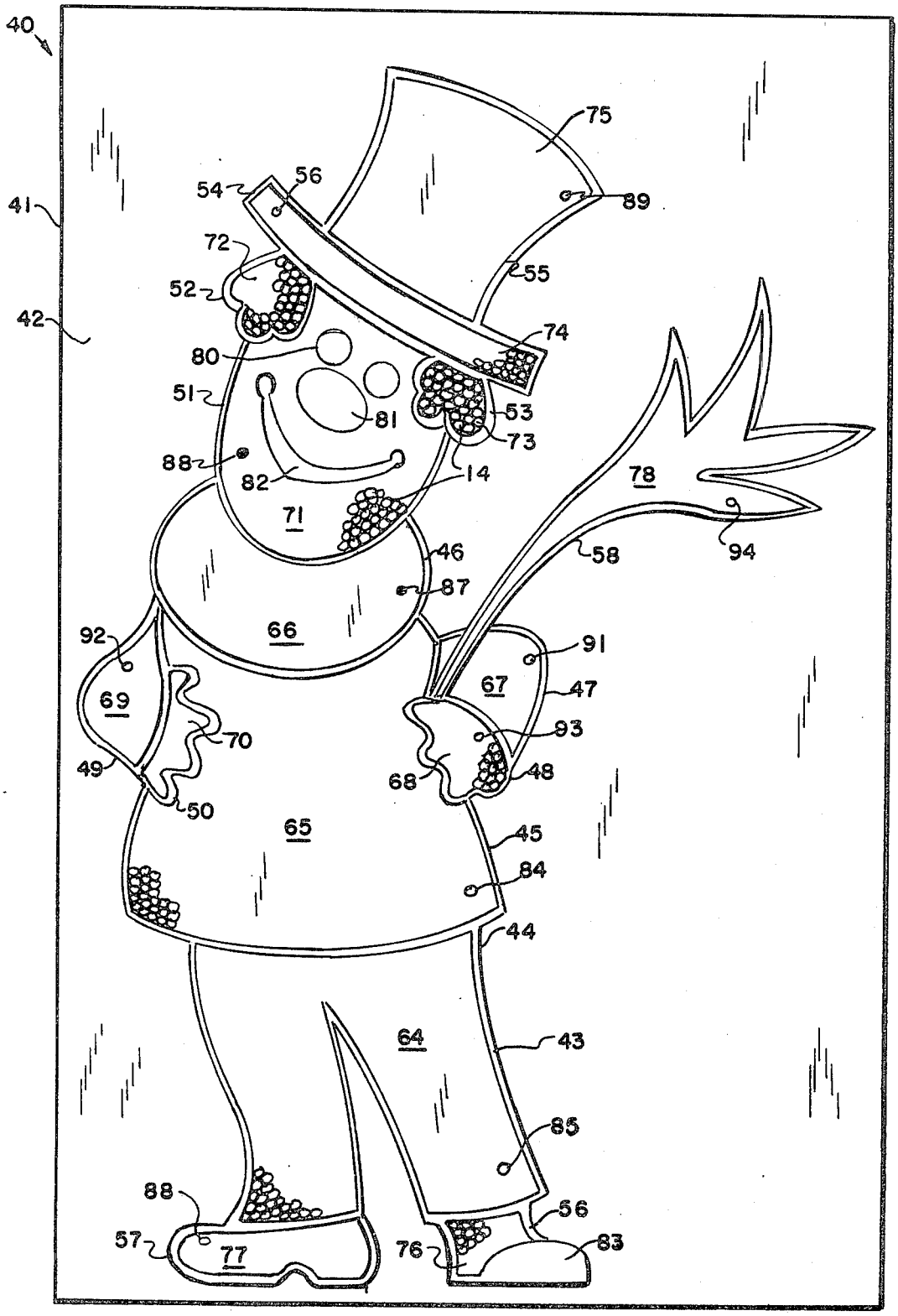
FIG. 19 is a face view of a modified form of the assembly toy and craft illustrated in FIG. 1.

FIG. 19 illustrates a modified form of the assembly toy and craft shown in FIG. 1. The assembly, denoted 40, is composed of a base sheet or board 41 which may be made of any suitable material such as paperboard, wood, plastic, metal or laminates of these materials. The outer surface 42 of board 41 may be of any suitable finish and color although the most attractive finish therefor is one in which a black flocking material has been applied for appearance purposes. Secured to or forming an integral molding with board 41 is a frame 43 which protrudes outwardly from surface 42 and serves as a fence defining a plurality of separate and distinct areas denoted 64–79 within each of which selected of the small components denoted 14 in FIG. 19 of respective colors may be assembled to, in effect, surface decorate and color the various confined areas for composing a most attractive picture thereof.

While board 41 is illustrated as a flat picture forming member, it is noted that it may also be configured as a three-dimensional shape such as that of a mock animal, figure, vehicle or building containing a fence-like frame configuration protruding outwardly from the surface thereof.

In FIG. 19, frame 43 is shown as composed of a portion 44 defining area 64 simulating the legs of the mock figure, portion 45 surrounding area 65 defining the coat of the mock figure, frame portion 46 surrounding surface area 66 defining the collar portion of the mock figure. These three areas, 64, 65 and 66, may be filled in with small plastic components of the same color, such as black or dark blue components, or of separate colors. Frame portions 47 and 49 define areas 67 and 69 which simulate the arms of the mock figure and are preferably filled in with small components having the same colors as those inserted into area 65. Frame portions 48 and 50 define areas 68 and 70 which simulate the hands of the mock figure and are preferably filled in with small components 14 of pink color. Frame portion 51 defines facial area 71 which is preferably filled in with small pink colored components. Frame portions 52 and 53 define areas 72 and 73 and are configured to represent portions of the hair of the mock figure. These portions may be filled in with yellow, brown or black decorating components 14.

Frame portions 54 and 55 respectively denote areas 74 and 75 which represent portions of the simulated hat of the mock figure decoration and are preferably filled in with the same colored small plastic components. Frame portions 56 and 57 respectively denote areas 76 and 78 and simulate the shoes of the mock figure.

Frame portion 58 surrounds an area 78 and is representative of an article carried by the mock figure such as a flower or plant. Also illustrated in FIG. 19 are certain portions or extensions of the frame 43 which define solid portions of the surface decorations. Portion 83 defines part of the left shoe of the mock figure and is a solid extension of the portion 56 of frame 43. Decorating portions 80, 81 and 82 simulate respectively the eyes, nose and mouth of the mock figure and may be either integrally molded against or with the surface of board 41 or assembled and secured thereto by adhesive or other means from molded components.

Notations 84–94 respectively refer to indicia provided by printing or molding against surface 42 which indicia indicates the colors of the small plastic components recommended to be assembled in the various frame-separated areas 64–78 of the mock figure. For example, these indicia may comprise small colored dots applied to the surface of the board within the confined areas by printing or other suitable means. They may also comprise small letters or numbers which are printed or integrally molded against the board 41.

Figure 20:
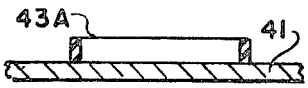
FIG. 20 is a fragmentary view in cross-section of one construction of the baseboard employed in the embodiment of FIG. 19.

In FIG. 20 is shown a first construction board and frame of FIG. 19. The board 41 is shown having the frame or frames 43A bonded to its upper surface. The frame 43A may be made of molded plastic or die cast metal. It may be the same color as that of surface 42 or a color distinct therefrom.

Figure 21:
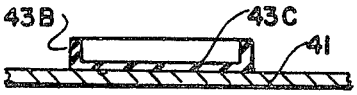
FIG. 21 is a fragmentary view in cross-section of another form of the construction of the structure of FIG. 19.

In FIG. 21, the board 41 contains a tray-like formation 43B having side walls and a bottom wall 43C which is bonded or otherwise secured to the outer surface of board 41. The tray 43B may be molded of plastic and configured, in plan view, as shown in FIG. 19.

Figure 22:
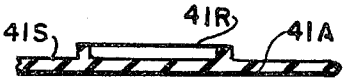
FIG. 22 is yet another form of construction of the structure shown in FIG. 19 and is also illustrated in fragmentary cross-section.

In FIG. 22, the board 41A is formed of a surface portion 41S which is integrally molded with outwardly protruding rib formations 41R which conform to the configuration of the frame 43 of FIG. 19 or any suitable configuration defining different confined areas adapted to receive different colored small decorating components described.

It is noted that while the mock figure defined by frame 43 of FIG. 19 is shown as secured to or forming part of a baseboard 41 so as to permit the user to form a picture-like structure, the border defining portions of the frame may comprise the border of the base itself without providing the frame on a rectangular board such as board 41. In other words, the toy may be composed of a flat or three-dimensional base having a border contour configured to the contour of the mock figure, animal, vehicle or other shape adapted to be decorated by means of the described small components.

Modifications in the structures and materials employed in the assembly toys and crafts hereinbefore described are noted as follows:

I. The structure 41 of FIG. 19 defining the base sheet and the frame portion 43 thereof which defines the partitions for the various material retaining areas 64,65,66,67,68,69,70,71, etc. may be formed of a single sheet of plastic by so called vacuum forming in which a sheet of plastic is deformed by fluid pressure while in a heat softened condition, against a mold which is shaped to define said frame portion as a ridge-like protrusion extending along these portions of the sheet in which the frame is to be formed, somewhat like the structure shown in FIG. 22.

II. The upper surface of the frame portion 43 may be metallized or colored to represent metal such as gold, bronze, copper, white metal or silver so that when the material retaining areas are filled with decorating material, it will appear as if a metal frame of the type used to make stained windows has been employed and a very attractive craft picture is derived.

III. Instead of a flat sheet-like base, the vacuum formed or molded frame containing retainer may have a contour which is the contour of the article which it is intended to represent such as the contour of a figure, animal, reptile, fish, insect, plant, flower or other object.

IV. The framed volumes 64–78 may be each at least partly filled with a colored casting material such as a casting resin which has been poured therein to provide, when solidified, an attractive multiple colored art piece. Each of the volumes 64–78 may be filled or partly filled with a different colored casting resin or one which is different from those of the adjacent volumes so as to provide color contrast and the effect of a multiple colored painting or figure. The resins are poured into the volumes 64–78 to a level where they do not overflow the frame portion 44 nor do they mask its metallized color or finish.

V. In a modified form of molding toy, the frame 43A of FIG. 20 is compartmented as illustrated in FIG. 19 and is only bonded to the backing sheet 41 by means of an adhesive permitting it to be removed therefrom after the compartments or volumes 64–78 which are defined by the frame have each been filled with a colored casting resin and the resins have solidified thus providing a finished article which is composed of frame 43 and the colored resins filling the voids of the frame and bonded to the frame. The frame 43 may be cast or molded of plastic or metal in a shape conforming to a figure, animal or other object which it is desired to represent.

The casting material may comprise a two part acrylic resin such as methyl methacrylate, a polyester resin or any resin which will solidify at room temperature in a few hours after being cast by pouring different colored amounts of same into the volumes 64–78.

A suitable material for sheet 41 is a tacky film such as the specially plasticized packaging film known as Saran-Wrap in the range of ½ to 1 mil in thickness which will removably adhere to the flat side of a metal or plastic frame 43 in such a manner as to prevent leakage of plastic resin when first poured into the volumes defined by the frame 43. Such film may be retained as a backing sheet in assembly with the frame 43 after casting has been completed or may be peeled off the frame and cast plastic after casting has been completed and the resin has hardened within the confines of the frame and has become bonded to the frame to retain it in assembly therewith.

I claim:

1. A molding craft comprising in combination:

a sheet-like base formed with a bottom wall portion and a plurality of ridge-like formations molded integral with said bottom wall and projecting upwardly therefrom, said ridge-like formations defining separate compartments each totally circumscribed by respective of said ridge-like formations, said ridge-like formations having a continuous upper rim defining respective envelopes of narrow surfaces representing partitions between said compartments, a plurality of different quantities of differently colored casting materials disposed within each of said separate compartments and solidified in situ therein and each bonded to the bottom wall portions of each compartment to define different colored decorations for said composite article, said narrow surfaces representing partitions between said compartments beng of different color than the colors of said different colored casting materials, said narrow surfaces extending above the level of said casting materials filling said compartments so as to be easily distinguishable by color and relief from the different colored casting materials in said compartments.

2. A molding craft in accordance with claim 1 wherein said bottom wall and said ridge-like formations of said base are molded from a single sheet of plastic.

3. A molding toy in accordance with claim 1 wherein said bottom wall and said ridge-like formation of said base are integrally formed of a single injection molding.

4. A molding toy in accordance with claim 1 wherein said bottom wall and said ridge-like formation of said base are of a color simulating a metal such that said narrow surfaces appear to define metallic partitions between said compartments.

* * * * *